US006116229A

United States Patent [19]

Wu

[11] Patent Number: 6,116,229

[45] Date of Patent: Sep. 12, 2000

[54] HAND-HELD SAFE DISK SHOOTING TOY

[76] Inventor: Wen-Long Wu, No. 5, Alley 26, Lane 62, Tung-Hsing Rd., Ta-Li City, Taichung Hsien, Taiwan

[21] Appl. No.: 09/212,402

[22] Filed: Dec. 16, 1998

[51] Int. Cl.[7] ..... F41B 4/00

[52] U.S. Cl. ..... 124/6

[58] Field of Search ..... 124/1, 6, 8, 21, 124/40, 78, 82

[56] References Cited

U.S. PATENT DOCUMENTS 3,717,136 2/1973 Gay et al. ..... 124/21

4,672,942 6/1987 Steward ..... 124/1

5,050,575 9/1991 Killion ..... 124/8

5,611,322 3/1997 Matsuzaki et al. ..... 124/6

5,782,228 7/1998 Wu ..... 124/6

*Primary Examiner*—John A. Ricci

*Attorney, Agent, or Firm*—Bacon & Thomas, PLLC

[57] ABSTRACT

Disks formed from soft and light material are safely shot by a toy having a device for individually feeding disks stored in a cylinder to a motor-driven ratchet panel which rotates at a high speed for engaging and shooting the disks from the toy.

5 Claims, 8 Drawing Sheets

HAND-HELD SAFE DISK SHOOTING TOY

BACKGROUND OF THE INVENTION

This invention relates to a shooting toy, more particularly to a hand-held safe disk shooting toy that can be refilled simply and rapidly for safe shootings.

As sound and lighting effects produced by devices have become popular, many toys are designed according to this trend, and the prevailing shooting toy is just one of those popular toys. However, the bullets used in a conventional shooting toy are of hard material that may hurt people when shot under high power. Such toys are also complicated, expensive and difficult to use.

SUMMARY OF THE INVENTION

This invention is a hand-held safe disk shooting toy characterized by easy refilling, rapid feeding, and high speed shooting of light and soft disks for providing both enjoyment and an assurance of safety.

An object of this invention is to provide a hand-held safe disk shooting toy which is designed to shoot a disk after pivoting a feeding device that serves as a safety means to avoid accidents.

A further object of this invention is to provide a hand-held safe disk shooting toy wherein a pattern may be printed on the disk face to reduce friction between the disks, increase the shooting range, provide an attractive visage, and permit commercial use.

In order to achieve the foregoing objects, a grip is connected to a gadget platform of this invention, and the platform is provided with a feeding gap which is coupled to a disk-feeding device underneath. Plural disks are placed in the disk-feeding device, wherein the top disk is pushed into a stand-by position for shooting by a pushing feeder. The top disk is shot by a ratchet panel having an axis of rotation that is inclined to the axis of the stacked disks and driven to rotate at a high speed by a motor.

BRIEF DESCRIPTION OF THE DRAWINGS

For a better understanding of the present invention, together with further advantages or features thereof, a preferred embodiment will be described in detail below, with reference to the annexed drawings in which.

DETAILED DESCRIPTION OF THE PREFERRED EMBODIMENT

Figure 1:
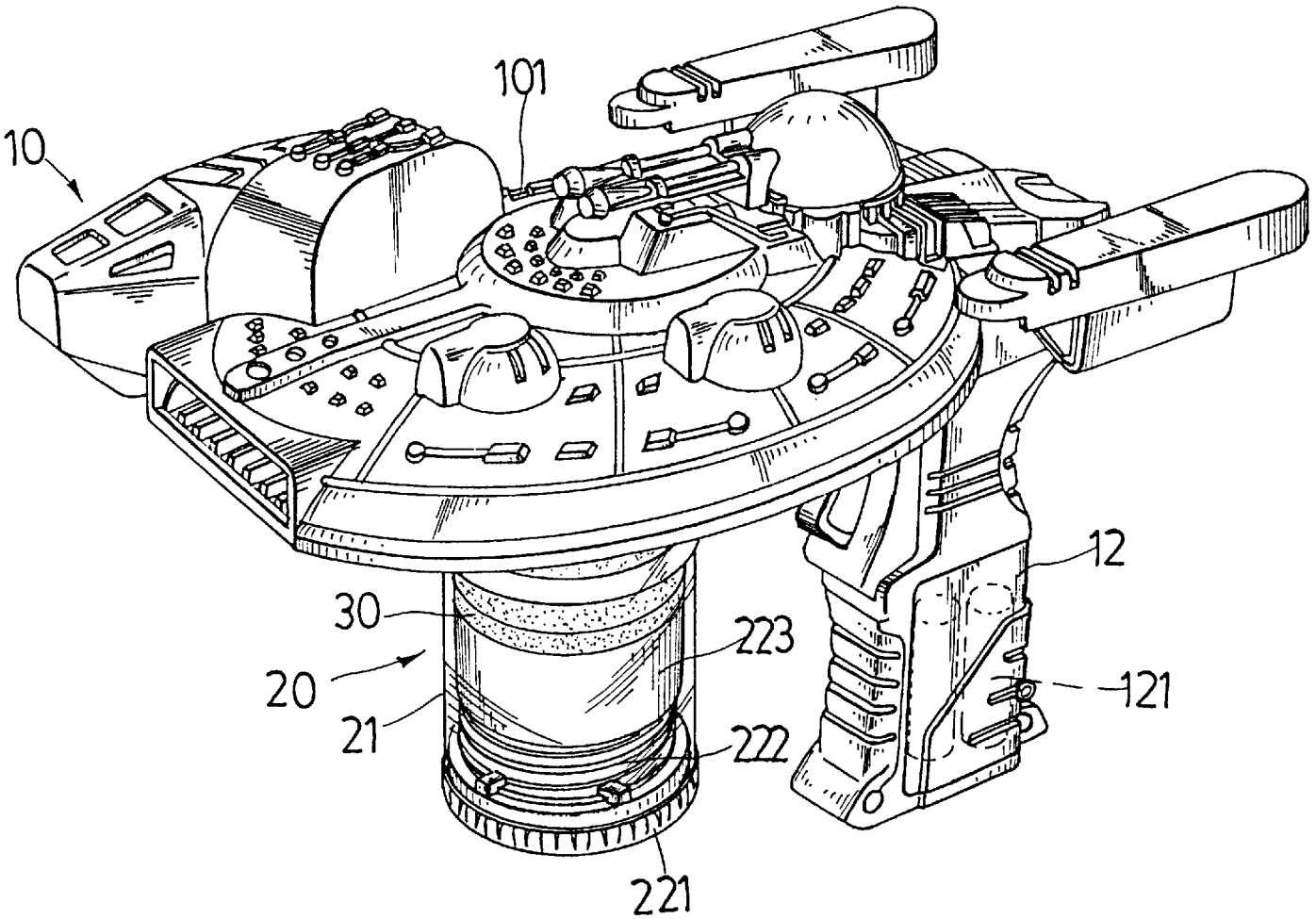
FIG. 1 is a perspective view of the invention.

This invention mainly comprises a gadget body 10, a disk-feeding device 20, a pushing feeder 50, a transmission motor 60, and a sound and lighting control element 70. Gadget body 10 includes a mantle 101 at its upper face that contains a gadget platform 11, wherein a hollow grip 12 is arranged underneath one end of the gadget platform 11. Both platform 11 and grip 12 are internally connected, and a cell device 121 provides a power supply for this invention.

A feeding gap 14 is provided on the gadget platform 11 at its front edge and in a radial direction. From a circumference on the bottom face of the gadget platform 11 corresponding to the position of the feeding gap 14, a ring body 15 is extended and internally connected to an inner edge of the feeding gap 14 to form a positioning sliding groove 17.

Figure 2:
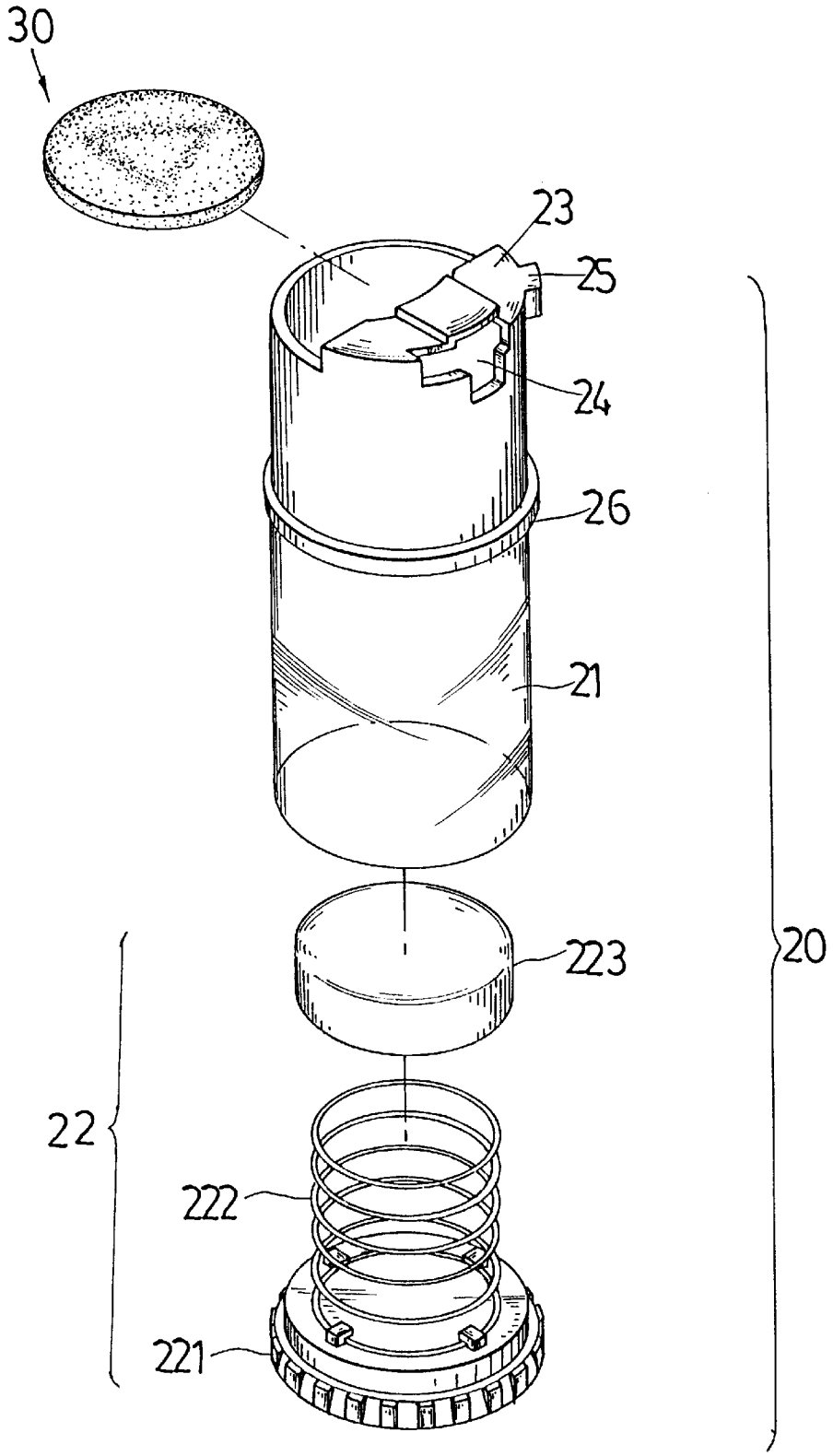
FIG. 2 is an exploded perspective view showing a disk-feeding device of the invention.

The disk-feeding device 20, as seen in FIG. 2, is installed beneath the feeding gap 14 and comprises a cylindrical body 21 with two open ends, a spring feeding mechanism 22 located beneath the cylindrical body 21 that includes a bottom stand 221, a spring 222 fixed on the stand 221, and a disk follower 223 placed on the spring 222. On top of the cylindrical body 21, a semi-circular covering strip 23 is provided and a push-to-move gap 24 is formed on an upper periphery of the cylindrical body 21 under a central portion of the covering strip 23. A protrusion piece 25 and a ring flange 26 are provided on the outer peripheral surface of cylinder 21 and spaced from the push-to-move gap 24.

A plurality of light and soft disks 30 may be filled in the disk-feeding device 20, wherein the disks 30 may be printed with a pattern or commercial message for the purpose of reducing friction between each other when they are stacked, thus permitting a further shooting distance. The disks 30 are loaded through a clearance between the covering strip 23 and the cylindrical body 21 and engaged by the disk follower 223. This causes the spring 222 to be squeezed downward and enable the covering strip 23 to retain the top disk 30 within body 21.

When assembling, the protrusion piece 25 of the cylindrical body 21 is located at the positioning sliding groove 17 of the feeding gap 14, the cylindrical body 21 is then pushed upwards until the protrusion piece 25 and the push-to-move gap 24 are disposed higher than the feeding gap 14 and extend over the gadget platform 11. The ring flange 26 will engage the bottom rim of the ring body 15 beneath the feeding gap 14 for positioning body 21 and the frictional force between the cylindrical body 21 and the ring body 15 will prevent body 21 from slipping down, while maintaining the top disk 30 at a position higher than the feeding gap 14.

The pushing feeder 50 includes a lateral trigger 51 connected to the handgrip 12, wherein the trigger 51 is extended internally to form a link lever 52 that extends above the gadget platform 11. The top end of the link lever 52 is coupled to a push lever 53 which extends horizontally across the gadget platform 11. When the trigger 51 is pushed inwardly toward the handgrip 12, the top end of the link lever 52 is driven towards the front edge of the gadget platform 11, and the push lever 53 will move to engage the top disk of the disk stack. The link lever 52 is connected to an end of a restoring spring 521, the other end of which is fixed on the gadget platform 11. When the trigger 51 is released, the restoring spring 521 will pull the link lever 52 back to its original position. In order to maintain the push lever 53 moving along a straight line, a guide track 54 is provided on the gadget platform 11 for guiding the reciprocal movement of push lever 53. Moreover, the push piece 531 is provided at the front end of lever 53 and includes a raised head, wherein the bottom edge of the push piece 531 extends to the bottom face of the push lever 53 to form an arc-shaped portion 532.

The transmission motor 60 is installed on a sound isolating socket 601 for reducing noise during its operation. The base of the sound isolating socket 601 is near the feeding gap 14, and the disposition of the motor 60 permits an attached ratchet panel 61 to engage and shoot the top disk away when the motor 60, which is coupled to a starting device 62, rotates at a high speed.

The starting device 62 includes a rotator 621 which is provided with a metallic element 622 centered nearby the positioning sliding groove 17 of the feeding gap 14. A protruded push piece 623, which is formed by extending a tangent line of the starting device 62 at its rim, is directed at the groove side of the positioning sliding groove 17. A small column 625, which is secured to one end of a restoring spring 626, is disposed near the rim of device 62. The other end of the restoring spring 626 is fixed to the gadget platform 11. A semi-circular stop washer 624 is attached to the rotator 621 at its top face to partially enclose the outer rim of the metallic element 622. The metallic element 622 is coupled to the cell device 121 and the motor 60 by conductive wires. A metallic conductive strip 63 is disposed on the gadget platform 11 at a position near the feeding gap 14 and is also coupled to the motor 60 by a conductive wire. Further, the metallic conductive strip 63 is bent into a slight arc shape so that it extends around the mouth of the feeding gap 14, and one end of the conductive strip 63 is folded to point at the metallic element 622 of the rotator 621.

Figure 3A:
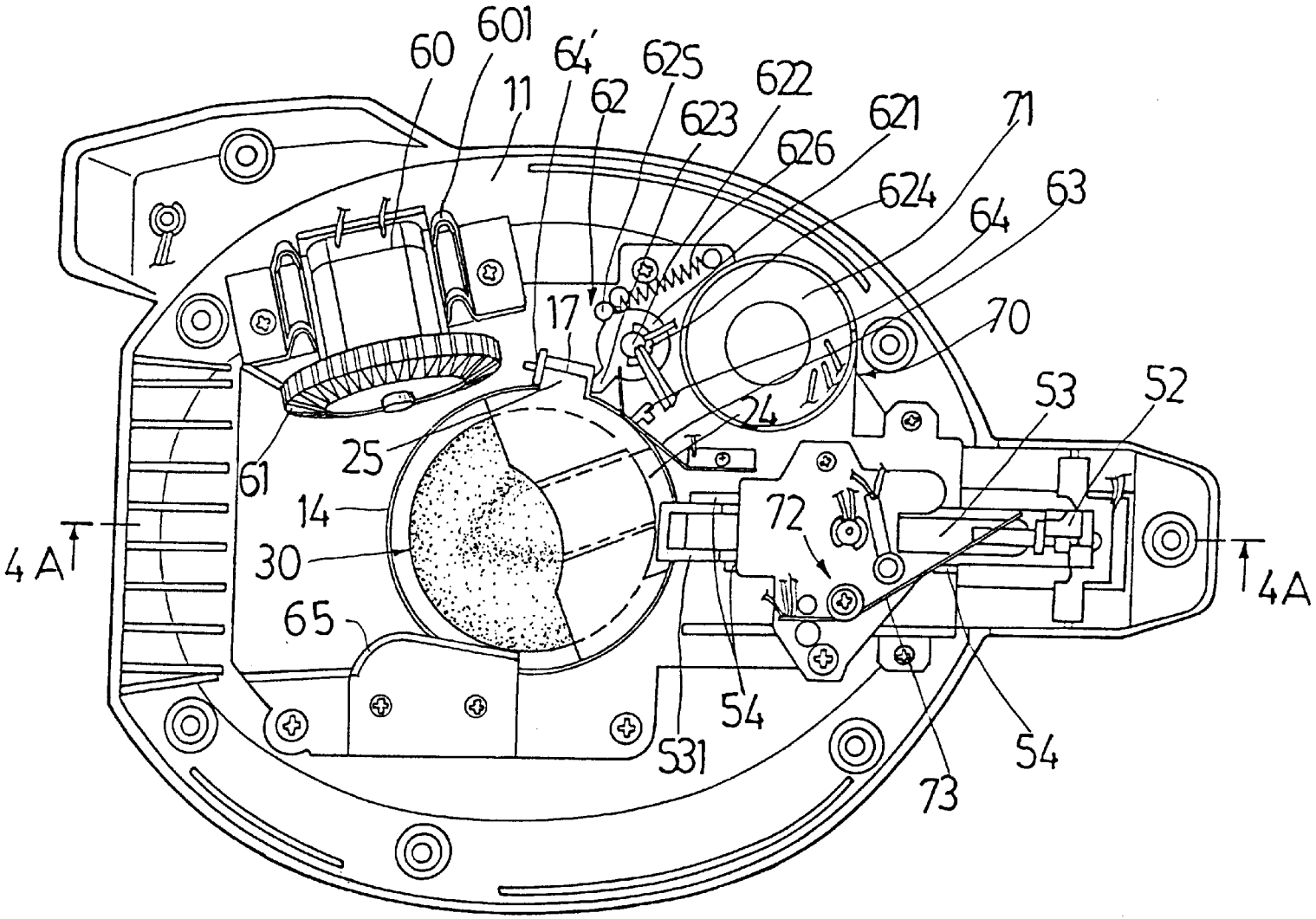
FIG. 3A is a plan view showing a gadget body and a push-to-feed device of the invention.
Figure 4A:
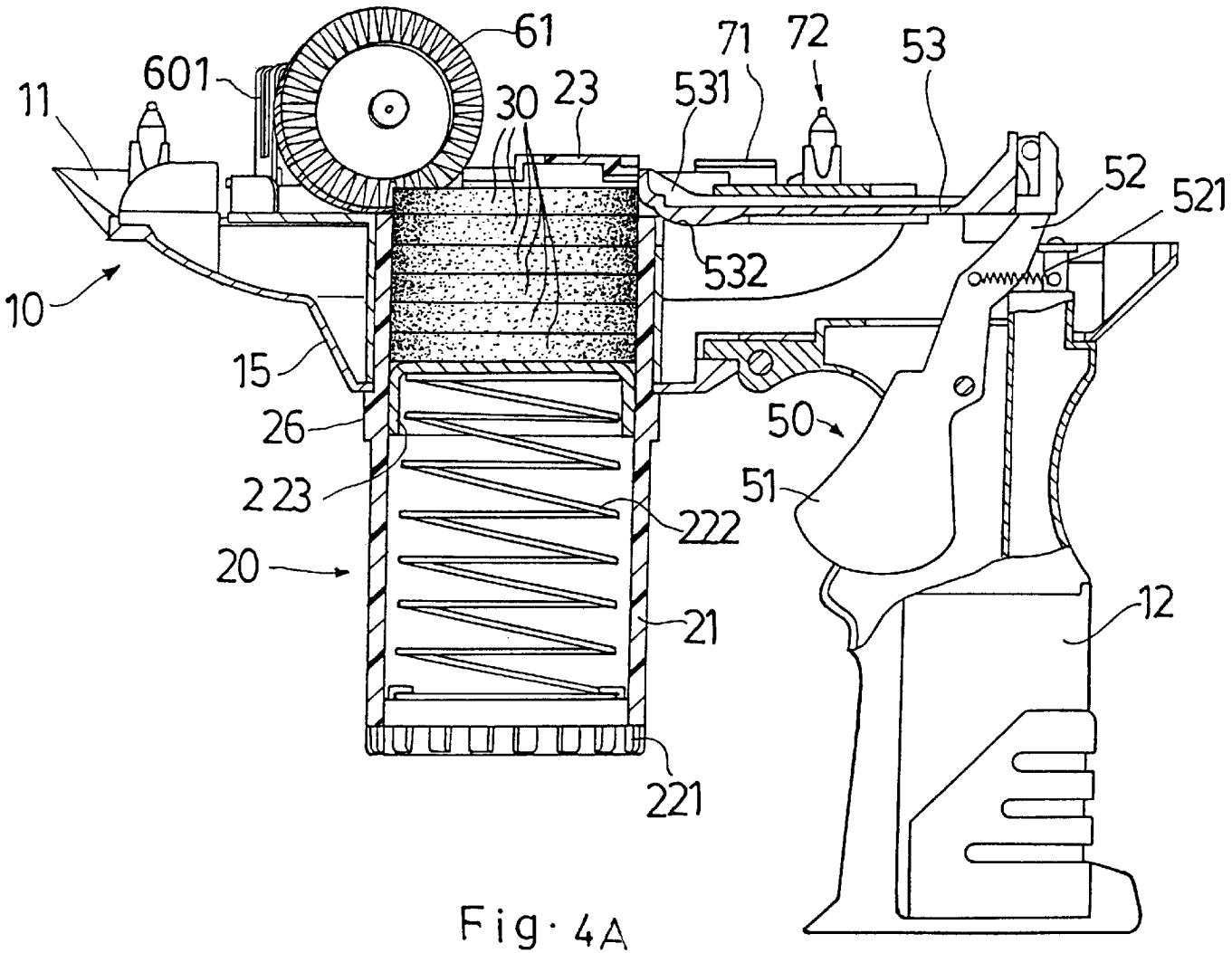
FIG. 4A is a partial sectional view taken along the line 4A—4A of FIG. 3A.

The starting device 62 is employed to start the motor 60. Power is supplied to the starting device 62 by pivoting the cylindrical body 21 of the disk-feeding device 20 a specified angle toward the rotator 621, as seen in FIGS. 3A and 4A. Thus, the protrusion piece 25 of the disk-feeding device 20 will push the protruded push piece 623 of the rotator 621 across a specified angle. An exposed portion of the metallic element 622 is thus pivoted to face the end portion of the conductive strip 63 which, in the meantime, is also moved towards the rotator 621 due to it engagement of the protrusion piece 25. Therefore, the end of the conductive strip 63 touches the exposed side of the metallic element 622 to activate the power supply that starts the motor 60 and drives the ratchet panel 61 to rotate at a high speed.

Figure 3B:
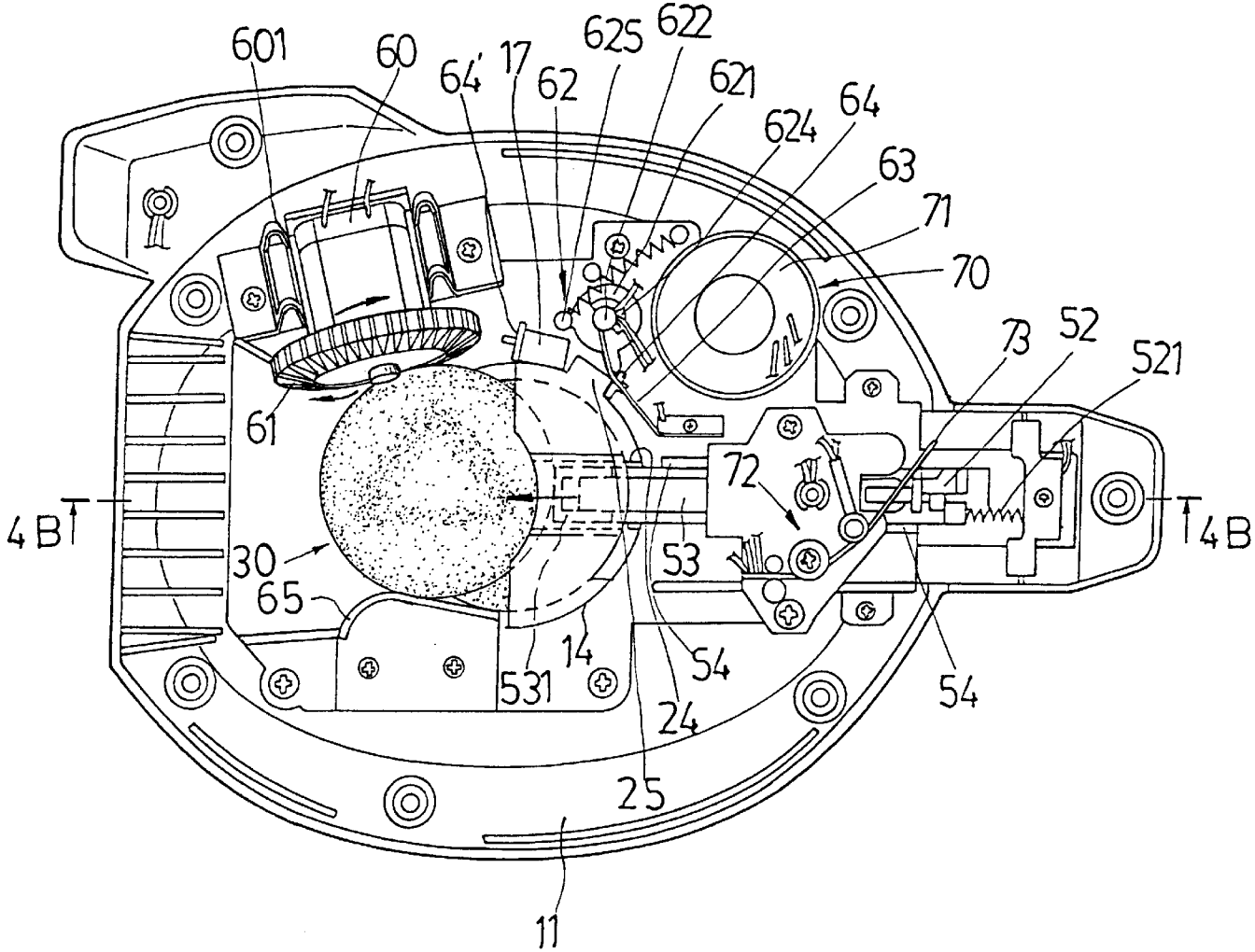
FIG. 3B is a plan view showing a gadget body and a forward action of the push-to-feed device of this invention.
Figure 4B:
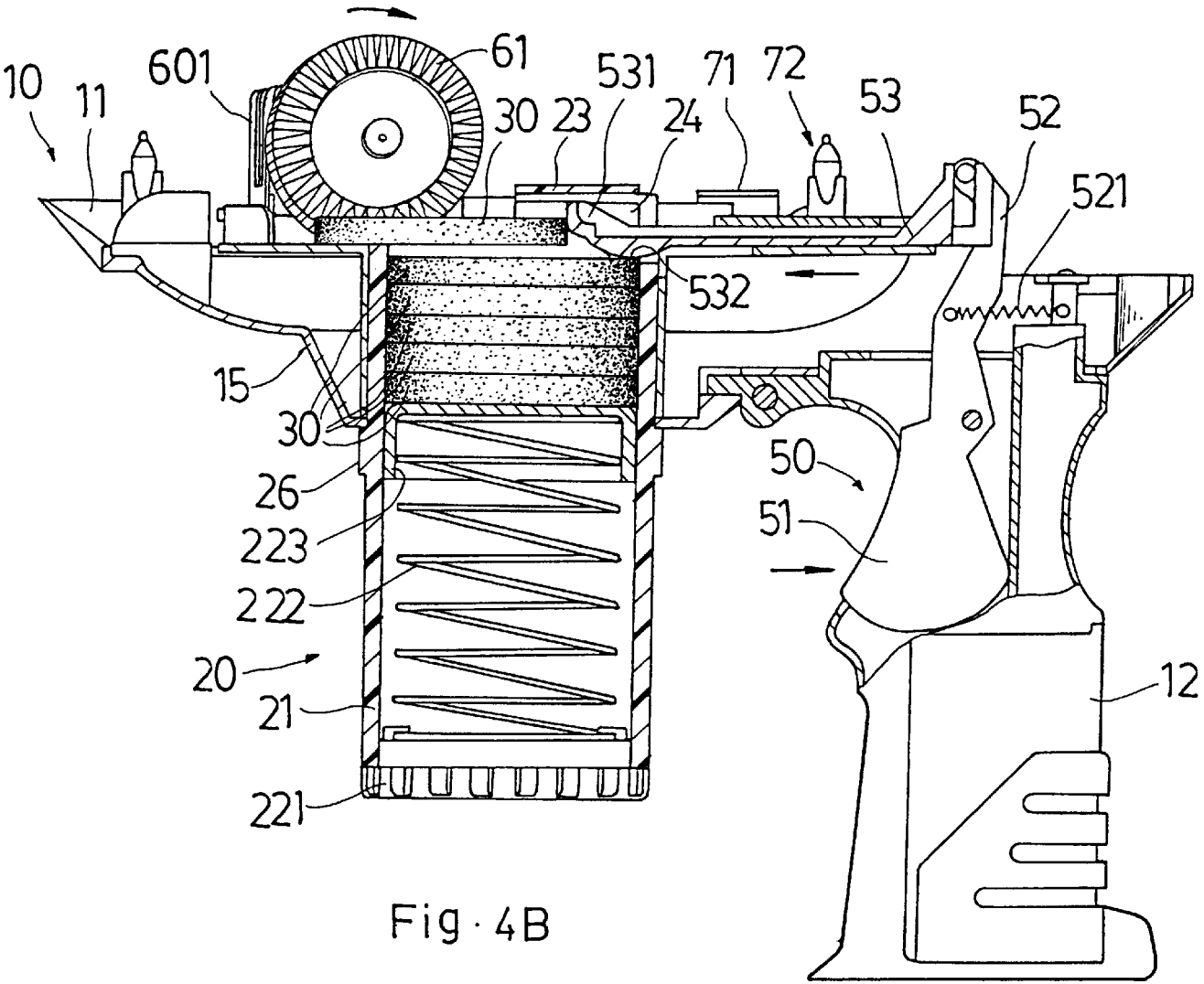
FIG. 4B is a partial sectional view taken along the line 4B—4B of FIG. 3B.
Figure 6:
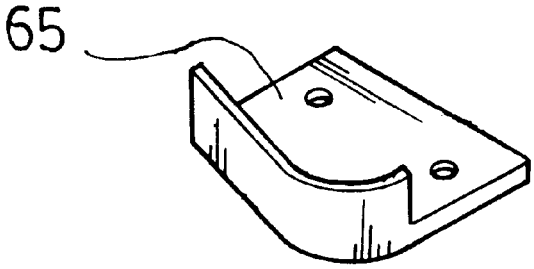
FIG. 6 is a perspective view showing a guide wall of the invention.

When the cylindrical body 21 is pivoted to start the motor 60, the push-to-move gap 24 is just coincident with the end of the push lever 53 of the push-to-feed device 50, and when the trigger 51 is pressed, as shown in FIGS. 3B and 4B, the push lever 53 is pushed forward to force the push piece 531 into the push-to-feed gap 24 to shove the top disk 30 into a stand-by position. The rim of the top disk 30 touches the lower surface of the upright ratchet panel 61 that rotates to throw the disk 30 away. The flying route of the disk 30 is guided by an L-shaped guide wall 65 disposed along the sliding straight line of the disk 30 on the gadget platform 11, as shown in FIG. 6. Moreover, a curved portion at an upper part of the guide wall 65 serves as a regulator for the disk 30 to lean against and provide both a track for approach and also stabilization of the movement of the disk 30 which is pinched by the guide wall 65 and the ratchet panel 61.

Figure 4C:
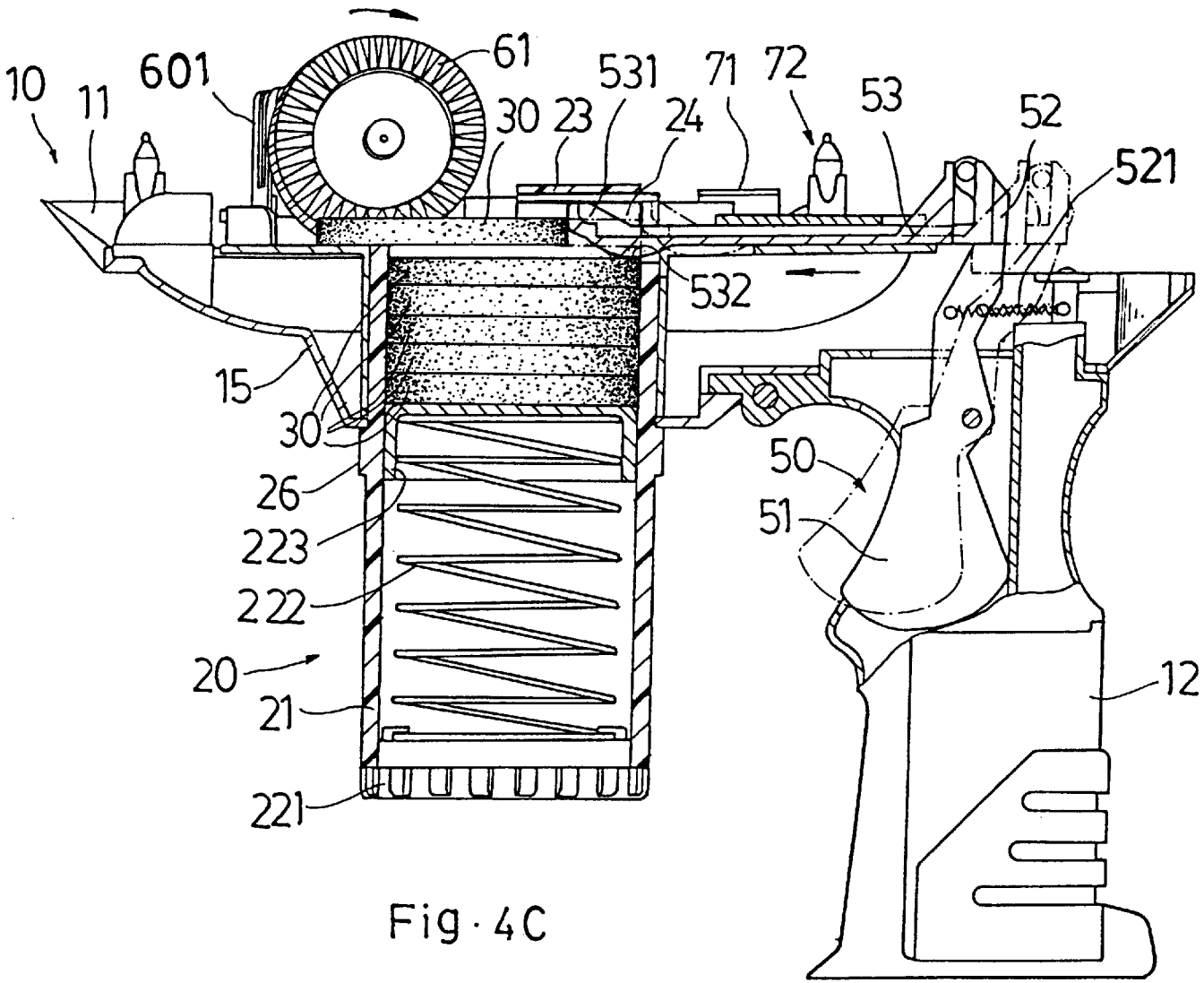
FIG. 4C is a partial sectional view showing the action of the device of FIG. 4A.
Figure 5:
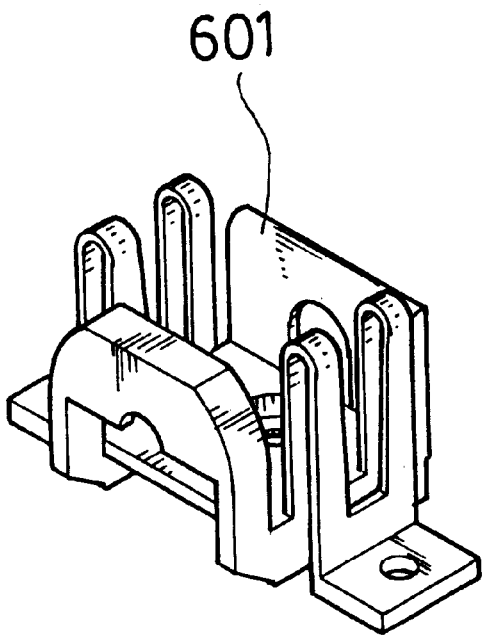
FIG. 5 is a perspective view showing a base of the sound isolating mantle of the invention.

When the push piece 531 of the push lever 53 pushes the top disk 30, as shown in FIG. 4C, the arc-shaped portion 532 and bottom edge of the push lever 53 that constrains the next disk 30 create a clearance between the top two disks 30 to avoid throwing both of them at the same time. Since there is no substantial contact between them, the top disk 30 can fly over a farther range.

For stopping the motor 60, the procedure includes reverse pivoting the cylindrical body 21 to detach the protrusion piece 25 from the rotator 621 which will be pulled back to its original position by the restoring spring 626. The conductive strip 63 will depart from the metallic element 622 of the rotator 621 and return back due to lack of support by the protrusion piece 25. The power supply is shut off and the motor 60 is stopped. At this moment, the push-to-move gap 24 of the disk-feeding device 20 is no longer coincident to the push lever 51, and pressing the trigger 51 cannot push the push piece 531 of the push lever 53 forward to push the disk 30 into the stand-by position. When the motor 60 is stopped, the trigger 51 cannot be pressed and no disk 30 is retained at a stand-by position. When the motor is started again, no disk 30 will shoot out before pressing down the trigger 51 in order to assure security.

For limiting the pivoting of the cylindrical body 21, two stoppers 64, 64' are disposed adjacent to the positioning sliding groove 17 at opposite sides thereof on the gadget platform 11. Stopper 64 limits the protrusion piece 25 when the cylindrical body 21 is pivoted to start the motor 60, while stopper 64 limits the protrusion piece 25 when the cylindrical body 21 is pivoted in reverse to stop the motor 60.

Sound and lighting control element 70 includes a presettable buzzer 71 and a sound and lighting control electronic element 72 on the gadget platform 11, both being coupled to the cell device 121. Both elements 70 and 72 are conventional items known in the art. The sound and lighting effect of this invention will not be activated when the device is started, only at the time the trigger 51 is pressed to shoot out the disks 30. Therefore, the buzzer 71 and the sound and lighting control electronic element 72 are controlled by an automatic switch 73, which activates only when the link lever 52 is driven by the trigger 51. The automatic switch 73 is arranged along the moving route of the push lever 53 to enable the link lever 52 to activate switch 73 when the link lever 52 is pushing the disk 30 to the stand-by position, thus creating a sound and lighting effect accompanying a flying disk 30.

A player holds this invention by the handgrip 12, then presses the trigger 51 to drive the link lever 52 and the push lever 53 forward to push the top disk 30 of a disk stack to the stand-by position. By virtue of the high speed rotating ratchet panel 61, the disk 30 will be thrown to fly with a sound and lighting effect.

As described herein, shooting the disk 30 depends mainly on cooperation of the motor 60 and the ratchet panel 61, while the printed pattern on the disk 30 also controls the shooting range. The disk 30 is made of soft and light material, such as rubber, vinyl chloride, or polyvinyl resin, to avoid hurting people. Since friction between the disks is increased and will drag a disk underneath to slide when a disk is pushed to the stand-by position by the disk-feeding device 50, the printing of a pattern on the surface of the disks reduce friction and facilitates in pushing a disk to the stand-by position and permitting the disk to be shot to a farther range.

Though the invention has been described according to one preferred embodiment thereof, it is apparent that numerous variation or modifications may be made to the invention without departing from the spirit and scope thereof, as set forth in the following claims.

What is claimed is:

1. A hand-held safe disk shooting toy, comprising:

a) a body having a platform thereon, a hollow grip at a bottom end of said platform, the grip being internally accessible to said platform, a power supply provided within said grip, a feeding gap on said platform at a front rim thereof and positioned in a radial direction, a positioning sliding groove disposed at an inner edge of said feeding gap, and said platform further including:

b) a disk-feeding device including a pivotable cylindrical body, a spring disposed within the cylindrical body, a covering strip at atop of said cylindrical body, a push-to-move gap formed in the cylindrical body adjacent said covering strip, a protrusion piece adjacent said push-to-move gap and located at the positioning sliding groove of the feeding gap;

c) a plurality of disks stacked in said cylindrical body and urged against said covering strip by said spring;

d) a pushing feeder device including a trigger carried by said grip, the trigger being linked to a push lever disposed horizontally on said platform, whereby when said trigger is pressed towards the grip, said push lever will slide forward to a front side of said platform, a spring for restoring said push lever back to its original position when said trigger is released, a push piece including a raised head located at a front end of said push lever and a bottom edge forming an arc-shaped portion that extends to a bottom face of said push lever;

e) a transmission motor, a sound isolating base supporting the motor on said platform adjacent to said feeding gap, a ratchet panel mounted to the motor for rotation thereby to throw each top disk away from the cylindrical body when said motor is in operation;

f) a starting device including a metallic element disposed adjacent said positioning sliding groove, said metallic element being conductively coupled to the power supply and said motor, a conductive strip disposed on said platform at a position adjacent said feeding gap, said conductive strip being conductively coupled to said motor and curved to pass by a mouth edge of said feeding gap, the conductive strip including a free end that is bent to point at said metallic element; and g) wherein when said cylindrical body of said disk-feeding device is pivoted at a preset angle towards said metallic element to enable said push-to-move gap to face said push lever, said protrusion piece pivots to engage said conductive strip and force its free end to contact with said metallic element to start said motor and rotate said ratchet panel at a high speed so that, when said trigger is pressed, said push piece at said front end of said push lever will enter said push-to-move gap to push a top disk from the cylindrical body to a stand-by position for said ratchet panel to shoot away, and when said cylindrical body of said disk-feeding device is pivoted in a reverse direction to detach said conductive strip from said metallic element, the operation of said motor is terminated.

2. The shooting toy of claim 1 wherein the disk-feeding device further includes a stand forming a bottom of said cylindrical body, a first end of the spring being disposed in engagement with said stand, and a disk follower being engaged on a second end of the spring.

3. The shooting toy of claim 1 further including a pair of stoppers disposed on said platform, the stoppers being positioned adjacent said positioning sliding groove, one stopper for limiting said protruded push piece when said cylindrical body is pivoted to start said motor, and the other stopper for limiting said protruded push piece when said cylindrical body is pivoted in the reverse direction to stop said motor.

4. The shooting toy of claim 1 wherein the body further includes a sound and lighting control electronic element provided with a buzzer on said platform, the element and buzzer being conductively connected to said power supply by an automatic switch positioned adjacent a path of movement of said push lever, whereby when said push lever pushes a disk to the stand-by position, said automatic switch is engaged to activate said electronic element for providing a corresponding sound and light effect when said disk is shot by said ratchet panel.

5. The shooting toy of claim 1 further including an L-shaped guide wall on said platform, the guide wall including a curved upper portion for guiding and stabilizing a thrown disk.

* * * * *